US010124231B1

(12) United States Patent
Scull et al.

(10) Patent No.: US 10,124,231 B1
(45) Date of Patent: Nov. 13, 2018

(54) SHUTTLECOCK LAUNCHING APPARATUS

(71) Applicant: Allan Sklar, Pointe-Claire (CA)

(72) Inventors: Harvey R. Scull, The Villages, FL (US); Stephen M. McConnell, Folsom, CA (US); Dmytro Pershko, Montreal (CA)

( * ) Notice: Subject to any disclaimer, the term of this patent is extended or adjusted under 35 U.S.C. 154(b) by 0 days.

(21) Appl. No.: 15/585,845

(22) Filed: May 3, 2017

(51) Int. Cl.

| | |
|---|---|
| ***F41B 4/00*** | (2006.01) |
| ***A63B 69/40*** | (2006.01) |
| ***A63B 67/187*** | (2016.01) |
| ***A63B 67/18*** | (2016.01) |

(52) U.S. Cl.
CPC ..... *A63B 69/406* (2013.01); *A63B 67/18* (2013.01); *A63B 67/187* (2016.01)

(58) Field of Classification Search
CPC ..... A63B 67/18; A63B 67/187; A63B 69/406
See application file for complete search history.

(56) References Cited

U.S. PATENT DOCUMENTS

| | | | | |
|---|---|---|---|---|
| 4,834,060 | A * | 5/1989 | Greene | A63B 69/406 124/78 |
| 5,125,653 | A * | 6/1992 | Kovacs | A63B 69/406 124/78 |
| 5,947,101 | A * | 9/1999 | Kerr | F41J 9/18 124/78 |
| 6,752,138 | B2 * | 6/2004 | Taryoto | A63B 67/18 124/78 |
| 7,553,244 | B2 * | 6/2009 | York | A63B 47/002 124/78 |
| 8,261,729 | B2 * | 9/2012 | Laszlo | A63B 67/18 124/51.1 |
| 9,448,031 | B2 * | 9/2016 | Wijegunawardana | F41B 4/00 |
| 2017/0136337 | A1 * | 5/2017 | Lee | A63B 69/40 |

* cited by examiner

*Primary Examiner* — John Ricci

(57) ABSTRACT

A shuttlecock loading mechanism with a grabbing mechanism and a pair of ejecting wheels defining a wheel plane. The grabbing mechanism receives a shuttlecock entering the loading mechanism in a vertical position and ejects the shuttlecock from the loading mechanism in an orientation parallel to the wheel plane wherein the pitch of the wheel plane about a wheel horizontal axis is selectively indexed about the wheel's horizontal axis.

16 Claims, 5 Drawing Sheets

SHUTTLECOCK LAUNCHING APPARATUS

RELATED APPLICATIONS

None.

FIELD

The present invention relates to the field of sporting games. More specifically, the present invention relates to apparatus used in the game of badminton or like games using shuttlecocks or other feathered missiles.

BACKGROUND

Many sports utilize machines for performing a competitive movement in order to provide practice for its players. For example, in baseball, pitching machines are widely used to provide practice for the batters. The use of the machines permits the batter to practice without requiring a pitcher to throw the balls. Similarly, puck shooting machines are used in hockey so that goalies can practice defending shots on goal. Additionally, a tennis ball launching machine is used in order to provide practice for tennis players.

Several machines for launching shuttlecocks are described in the prior art. For example, in U.S. Pat. No. 6,752,138 to Taryoto a plurality of shuttlecocks line up in a chute and the shuttlecocks are individually launched by a pair of spinning wheels. A feed mechanism comprises a motor driving a four spoke rotor. There are several drawbacks to this type of mechanism. This type of apparatus results in a significant change in trajectory of the shuttlecock prior to ejection, which results in a loss of velocity due to air pressure.

BRIEF SUMMARY OF THE INVENTION

It is the object of the present invention to provide a novel shuttlecock launching machine wherein shuttlecocks can be transported from a vertical storage tube using a plurality of rotating finger-like projections and coordinating levers to a pair of ejecting wheels, which can launch the shuttlecocks in a wide range of trajectories.

The present invention feeds the shuttlecock to the pair of ejecting wheels such that the shuttlecock is ejected in an orientation parallel to the surface plane of the wheels, said orientation causing the shuttlecock to be accelerated by the wheels and ejected with cork or base of the shuttlecock leading in the direction of the trajectory, and the cage section, whether made of feather or synthetic material, also passing between the wheels and trailing the cork, said orientation not causing the shuttlecock to significantly change orientation relative to the trajectory at the time of ejection, thus avoiding a loss of velocity due to air pressure, while maintaining the intended trajectory with greater accuracy.

The present invention comprises generally a plurality of rotating finger-like projections; a plurality of levers synchronized with the rotation of the fingers; and a pair of ejecting wheels defining a wheel plane wherein the levers coordinate with the rotating finger-like projections to receive a shuttlecock entering the loading mechanism in a vertical position and eject the shuttlecock from the loading mechanism in an orientation parallel to the wheel plane wherein the pitch of the wheel plane about a wheel horizontal axis; is selectively indexed about a wheel horizontal axis. A key point of novelty is that the shuttlecock is always entering the ejecting wheels in a plane that is perpendicular to the axis of rotation of the ejecting wheels.

DETAILED DESCRIPTION

Figure 1:
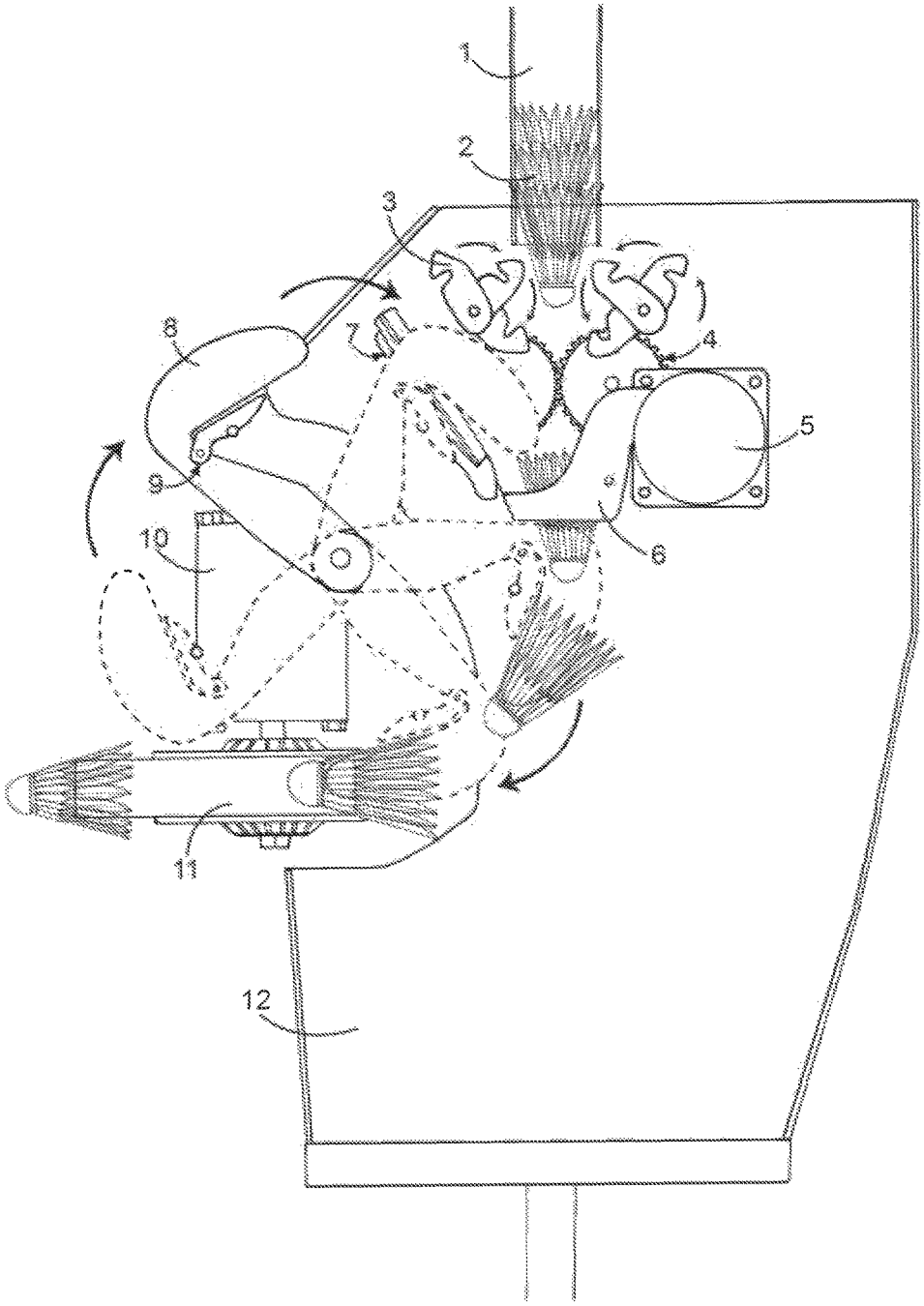
FIG. 1 is cross section view of the shuttlecock launching apparatus of the present invention.
Figure 2:
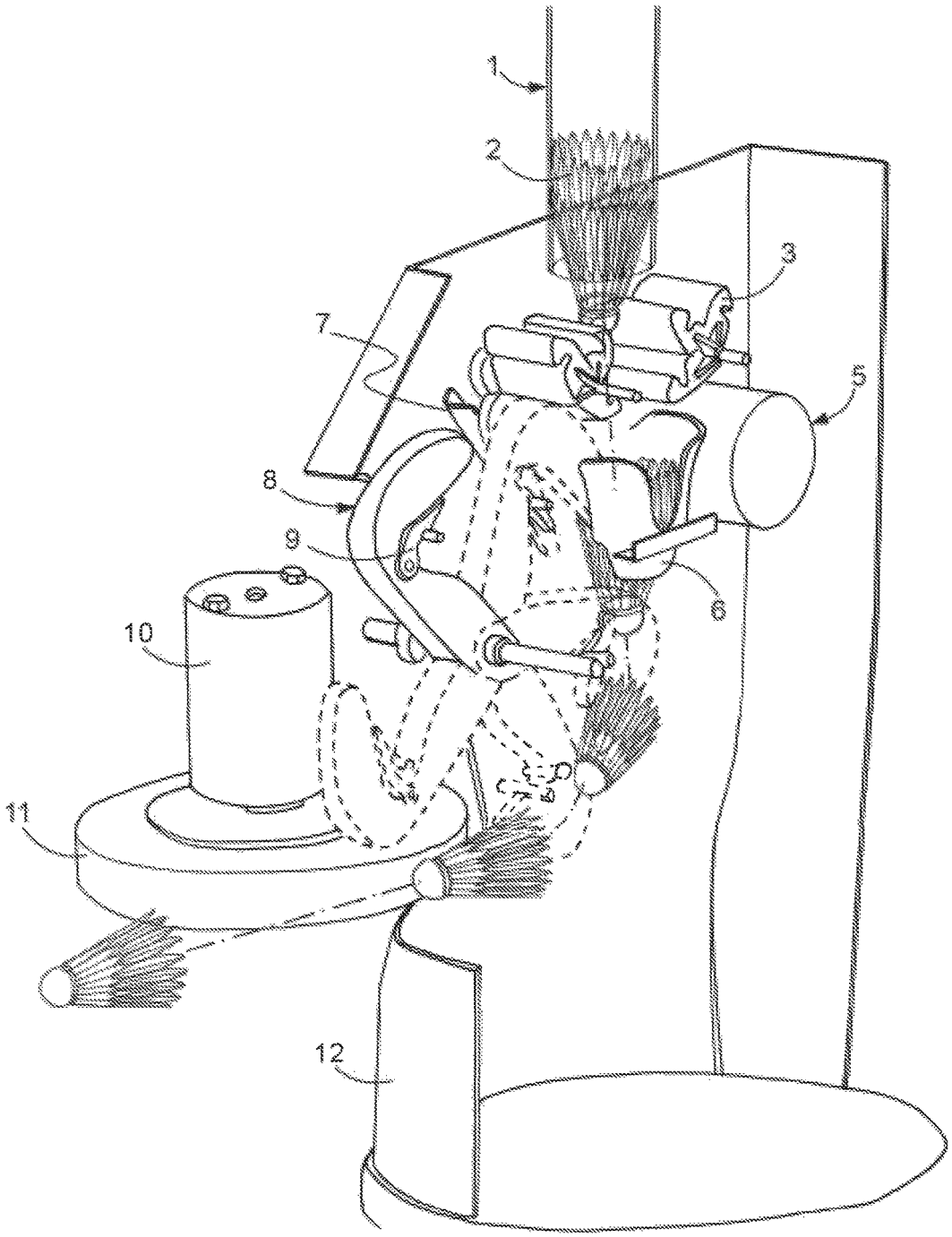
FIG. 2 is cross sectional side perspective view of the apparatus of FIG. 1.

Turning to FIGS. 1 and 2, the ejection wheels 11 are turned by throw motor 10 and the shuttlecocks 2 are gravity fed from the shuttlecock tube 1. One shuttlecock 2 is fed per cycle and is dropped in to the funnel 6 by the flippers 3. The flippers 3 and shuttlecock grabbing mechanism assembly 9 are related by gears 4 and the gears 4 are activated by a launch motor 5. Once the cycle starts, the flippers 3 and shuttlecock grabbing mechanism assembly 9 rotates at a certain ratio defined by the gears 4, both doing total of 360 degrees per cycle. During the cycle, the flippers 3 grab the shuttlecock 2 and pull the shuttlecock 2 out of the tube 1, which is gravity fed. The flippers 3 then lower the shuttlecock 2, and release it into the funnel 6. The shuttlecock 2 then sits in the funnel 6 and awaits the shuttlecock grabbing mechanism assembly 9. shuttlecock grabbing mechanism assembly 9 then grabs the shuttlecock 2 which is sitting in the funnel 6 and pushes it between and parallel to the ejection wheels 11 to be launched. Once the shuttlecock 2 touches the fast spinning ejection wheels 11 it is "torn" from the shuttlecock grabbing mechanism assembly 9 and launched out of the machine. Meanwhile, the flippers 3 drop another shuttlecock 2 in to the funnel 6 and this shuttlecock 2 will be launched on the next cycle. The cycle ends after shuttlecock grabbing mechanism assembly 9 rotates 360 degrees.

Figure 3:
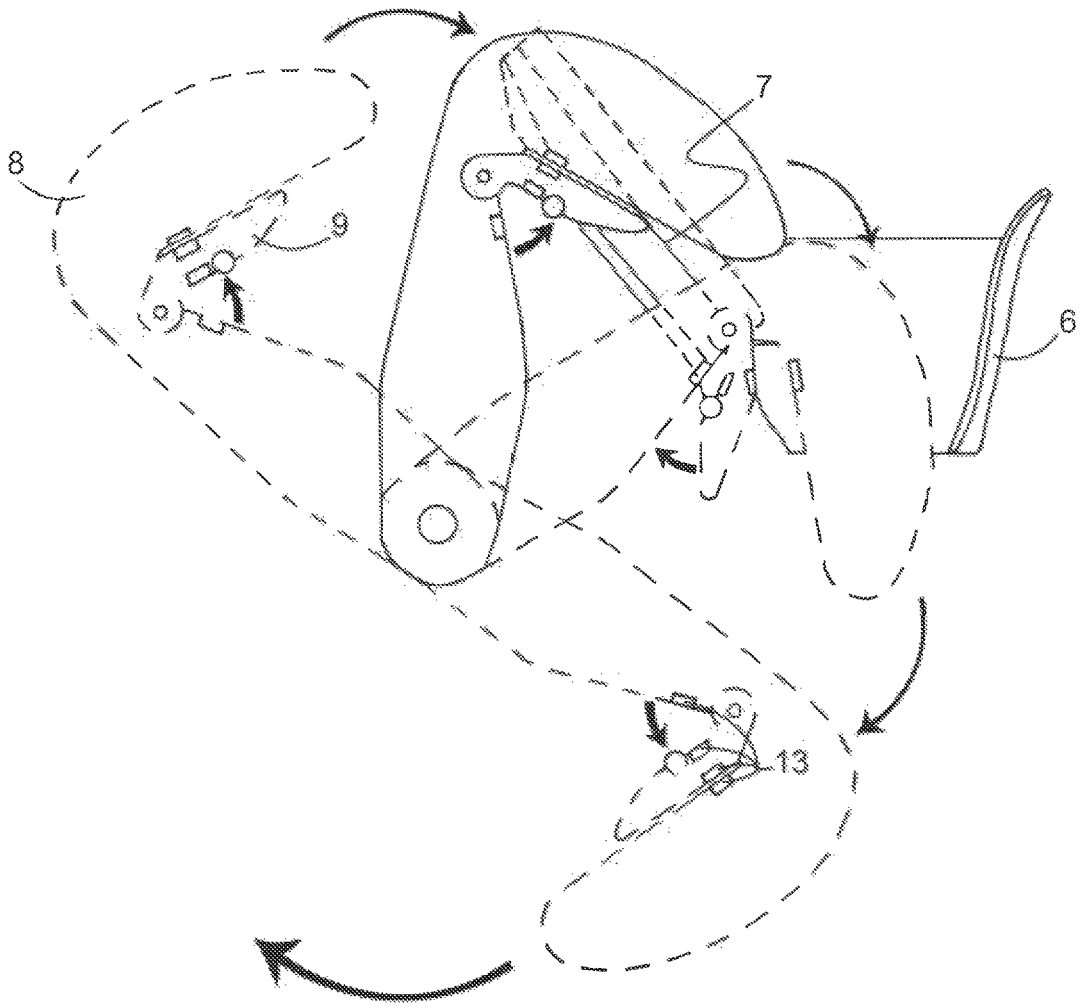
FIG. 3 is a side view of the shuttlecock grabbing mechanism of the present invention.
Figure 4:
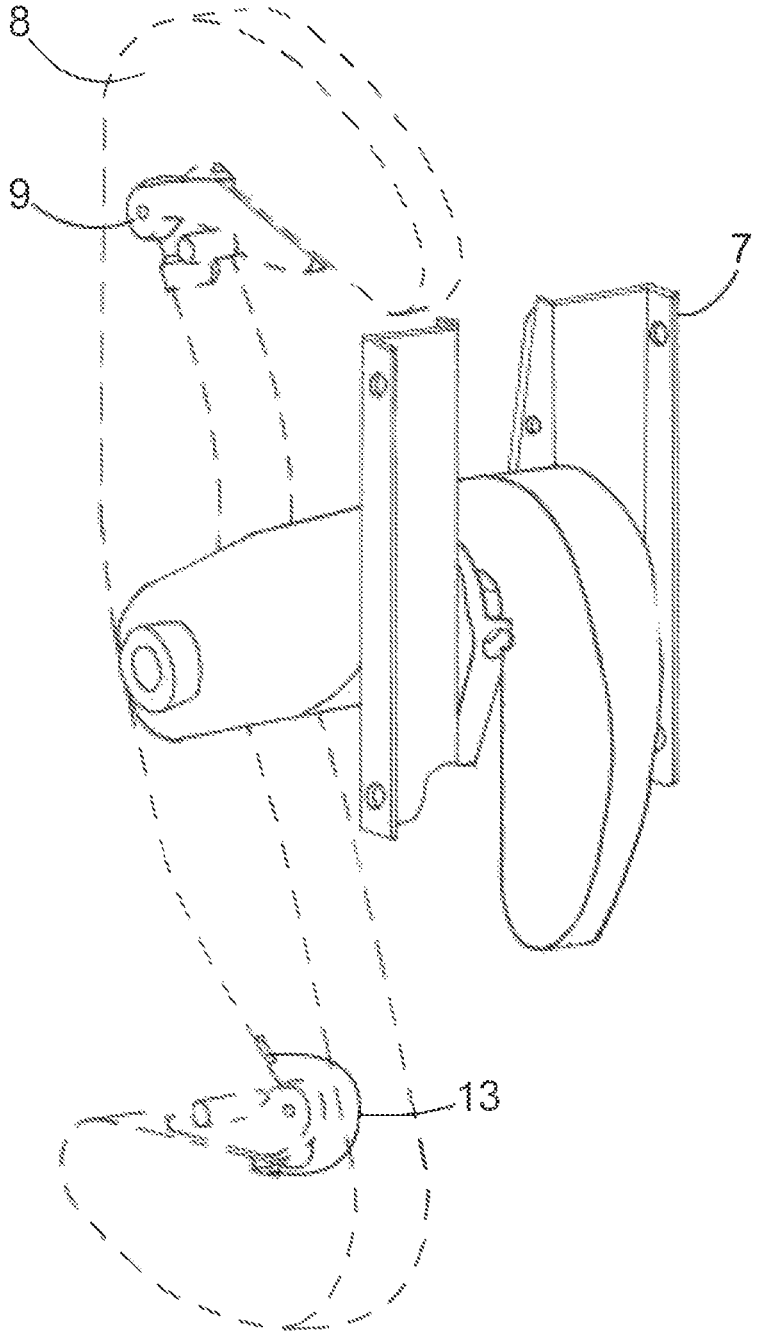
FIG. 4 is a side perspective view of the shuttlecock grabbing mechanism of FIG. 3.

Turning to FIGS. 3 and 4, the preferred embodiment of the shuttlecock grabbing mechanism is shown in further detail. Magnets 13 keep pincher 9 closed on the finger 8. In the preferred embodiment there is one finger 8 and four magnets 13; however, the invention is not limited to such a configuration. Two magnets 13 attract each other, and two other magnets 13 repel to help the pincher 9 to close. The finger 8 and pincher 9 combined assembly is activated by a gear mechanism and rotates full 360 degrees per cycle. When rotating, once the pincher 9 reaches the sleds 7, they force the pincher 9 open for a certain distance the finger 8 travels, and then when pincher 9 reaches the end of sleds 7, the magnets 13 will force the pincher 9 to the initial closed position, where it "grips" the shuttlecock 2 so that it does not slip out of position on the finger 8 as it advances into the ejection wheels 11.

Figure 5:
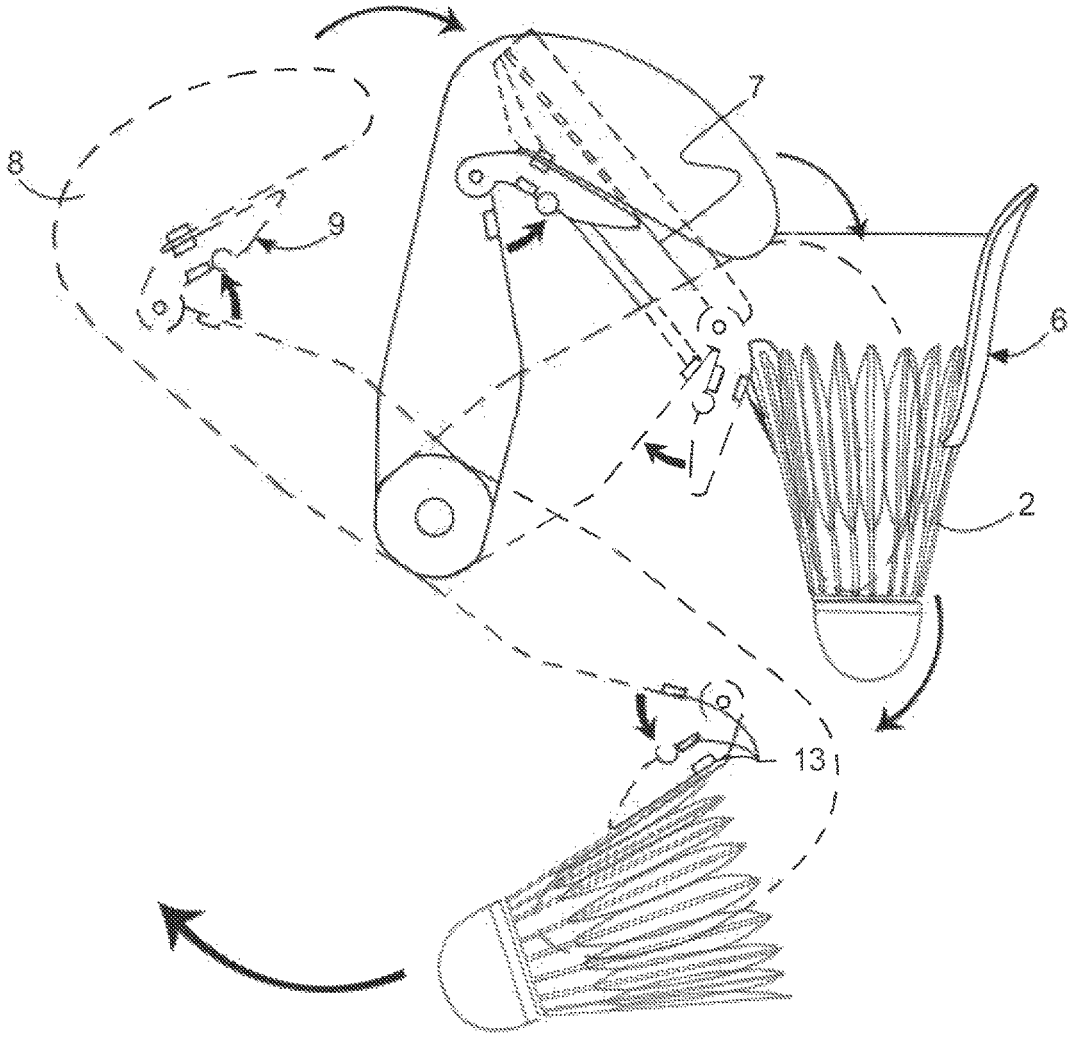
FIG. 5 is a side view of a shuttlecock moving through the shuttlecock grabbing mechanism of the present invention.

Turning to FIG. 5, the shuttlecock 2 sits in funnel 6 and the finger 8 starts its cycle. When the finger 8 and pincher 9 assembly reaches the sleds 7, the pincher 9 opens The finger 8 then pushes against the inside of the cork of the shuttlecock 2 When the shuttlecock 2 is almost pushed through the funnel 6, the pincher 9 closes and grabs the shuttlecock 2 by the feathers or cage. The finger 8 and pincher 9 assembly continues to rotate until the shuttlecock 2 touches the ejecting wheels 11 and gets launched. The finger 8 and pincher 9 assembly continues to rotate until it ends its 360 degrees' cycle.

The dotted lines in FIGS. 1-5 represent various positions the finger 8 may occupy during its 360-degree cycle. It is contemplated that more than one finger 8 could be used in the device.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A shuttlecock loading mechanism comprising a. a shuttlecock grabbing mechanism; and b. a pair of ejecting wheels defining a wheel plane wherein the shuttlecock grabbing mechanism is inserted as far as possible against an interior surface of a shuttlecock as it enters the shuttlecock loading mechanism and applies pressure to an opposing exterior surface of the shuttlecock.

2. The mechanism of claim 1 further comprising a motor and motor speed controller whereby a vertical linear velocity of the shuttlecock entering the loading mechanism is controlled by appropriate adjustment of the motor's rotational speed.

3. The mechanism of claim 2 further comprising a braking system and an acceleration system wherein the braking and acceleration systems are applied to the motor wherein the velocity of the loading mechanism is reduced or increased to change the rate at which the shuttlecocks are moved by the loading mechanism.

4. The mechanism of claim 2 further comprising at least one motor speed controller whereby a linear velocity of the ejected shuttlecock from the ejecting wheels is controlled by appropriate adjustment of the motors' rotational speed, and whereby the ejecting wheels can be controlled separately for different rotational velocities about the wheel horizontal axis.

5. The mechanism of claim 1 further comprising a means for rotating the wheel horizontal axis to change a horizontal vector of the ejection of the shuttlecock to launch the shuttlecock at various trajectories.

6. The mechanism of claim 5 further comprising a braking system and an acceleration system applied to the motors wherein the rotational velocities of the ejecting wheels are reduced or increased as required before the shuttlecock is inserted, in order to change the velocity at which the shuttlecock is ejected.

7. The mechanism of claim 6 wherein the braking and acceleration systems are applied to the rotation of the ejecting wheels whereby the rotation of the wheel horizontal axis is changed and motion stopped before the shuttlecock is inserted between the wheels.

8. The mechanism of claim 1 wherein said shuttlecock loader launches a natural feather shuttlecock for use in the game of badminton.

9. The mechanism of claim 1 wherein said shuttlecock loader launches a synthetic feather shuttlecock for use in the game of badminton.

10. A shuttlecock launcher device comprising:

a. a vertical shuttlecock dispenser c. a shuttlecock grabbing mechanism with a plurality of levers; and c. a pair of ejecting wheels assembly for gripping and propelling a shuttlecock by a nose or cap member of the shuttlecock wherein the plurality of levers coordinate with the shuttlecock grabbing mechanism to receive a shuttlecock one at a time from the vertical shuttlecock dispenser, grip an interior surface of the shuttlecock and feed the shuttlecock to the pair of ejecting wheels such that the shuttlecock is ejected from the mechanism in an orientation parallel to the wheel plane wherein the pitch of the wheel plane about a wheel horizontal axis is selectively indexed about a wheel horizontal axis.

11. The device of claim 10 wherein the vertical shuttlecock dispenser is capable of housing a plurality of shuttlecocks for dispensing in a queued manner.

12. The device of claim 10 further comprising a means for indexing the pitch of each wheel plane about the wheel horizontal axis to launch the shuttlecock at various trajectories.

13. The mechanism of claim 12 further comprising a braking system and an acceleration system wherein the braking and acceleration systems are applied to the motor wherein the indexing of the pitch of horizontal axis of each ejecting wheel is changed and motion stopped before the shuttlecock is inserted between the wheels.

14. The device of claim 12 further comprising a motor and motor speed controller whereby a linear velocity of the ejected shuttlecock from the ejecting wheels is controlled by appropriate adjustment of the motor's rotational speed.

15. The device of claim 10 further comprising a motor and motor speed controller whereby a vertical linear velocity of the shuttlecock received from the vertical shuttlecock dispenser is controlled by appropriate adjustment of the motor's rotational speed.

16. The device of claim 10 wherein the shuttlecock grabbing mechanism comprises a plurality of finger-like projection wherein the finger-like projection is inserted as far as possible against an interior surface of a shuttlecock as it enters the loading mechanism and the finger-like projection applies pressure to the opposing exterior surface of the shuttlecock.

* * * * *